United States Patent [19]

Lynham

[11] 4,330,107

[45] May 18, 1982

[54] TEAPOT LADLE AND METHOD OF USE

[75] Inventor: C. Richard Lynham, Medina, Ohio

[73] Assignee: Foseco Trading A.G., Chur, Switzerland

[21] Appl. No.: 204,948

[22] Filed: Nov. 7, 1980

[30] Foreign Application Priority Data

Jul. 8, 1980 [GB] United Kingdom ..... 8022253

[51] Int. Cl.[3] ..... B22D 41/04; B22D 41/02; C21C 7/00

[52] U.S. Cl. ..... 266/44; 266/280; 222/605

[58] Field of Search ..... 266/280, 283, 286, 44; 222/591, 604, 605

[56] References Cited

U.S. PATENT DOCUMENTS

| | | | |
|---|---|---|---|
| 1,344,688 | 6/1920 | Griner | 222/605 |
| 1,399,532 | 12/1921 | Whiting | 222/605 |
| 2,447,747 | 8/1948 | Goldberg | 222/605 |
| 2,556,125 | 6/1951 | Wallis | 222/605 |
| 3,373,047 | 3/1968 | Sheets et al. | 106/38.2 |
| 3,689,051 | 9/1972 | Miller | 266/275 |
| 4,012,029 | 3/1977 | Seguin et al. | 266/275 |
| 4,055,336 | 10/1977 | Massin | 266/275 X |
| 4,096,976 | 6/1978 | Daussan | 222/591 |
| 4,194,730 | 3/1980 | Matsumoto et al. | 266/275 |
| 4,216,944 | 8/1980 | Shimada et al. . | |

FOREIGN PATENT DOCUMENTS

| | | |
|---|---|---|
| 1364665 | 8/1974 | United Kingdom . |
| 1437062 | 5/1976 | United Kingdom . |
| 1454201 | 11/1976 | United Kingdom . |
| 1487040 | 9/1977 | United Kingdom . |
| 1511483 | 5/1978 | United Kingdom . |
| 1521177 | 8/1978 | United Kingdom . |
| 1537739 | 1/1979 | United Kingdom . |

OTHER PUBLICATIONS

National Carbon Company/Catalog Section S-50051, Aug. 1951/p. 10.

*Primary Examiner*—L. Dewayne Rutledge
*Assistant Examiner*—David Hey
*Attorney, Agent, or Firm*—Cushman, Darby & Cushman

[57] ABSTRACT

A teapot ladle has an interior lining of low thermal capacity, low thermal conductivity refractory material which in contact with molten metal poured into the ladle forms an erosion resistant surface, and means for retaining the lining in place when the ladle is tilted.

The lining material comprises inorganic fibrous material, particulate refractory material and an organic binder and the retaining means may be a refractory or metal ring which clips over the outer wall of the ladle and the inner wall of the lining, a series of clips or a rod shaped to fit over the top of the ladle and hold the lining in one place at one point on its perimeter.

30 Claims, 3 Drawing Figures

TEAPOT LADLE AND METHOD OF USE

Figure 1:
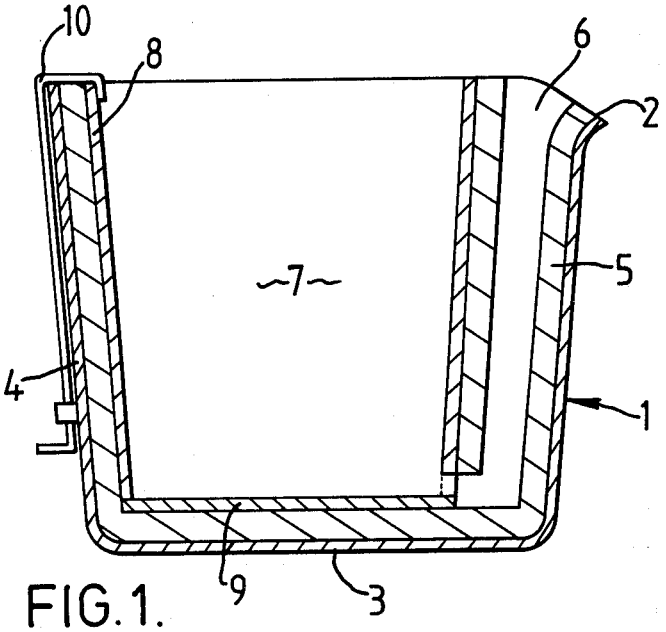

This invention relates to teapot ladles for molten metal and to a method of casting using such ladles.

Teapot ladles are usually fairly small in size, made of cast-iron, are roughly circular in cross-section and slightly tapered outwardly from the bottom to the top. Part of the upper rim of the ladle usually bulges outwardly to form a lip when the ladle is tilted. The ladle is lined with refractory material, such as sodium-silicate bonded sand and the lining has a vertical passageway or spout extending from the cavity of the ladle at the base of the lining to the lip. A pair of trunnions is usually provided on the outside wall of the ladle so that the ladle can be gripped and tilted. When the ladle is tilted molten metal passes through the vertical passageway and is poured out of the lip.

Teapot ladles of this type suffer from a number of disadvantages. To avoid molten metal poured into the ladle cooling excessively, or even freezing, the interior of the ladle must be preheated, and even though teapot ladles are generally of small capacity preheating can take an hour or more and the process is not only time-consuming but also uses appreciable energy.

After the ladle has been used to hold and pour molten metal the lining must be removed and replaced or at least repaired. In either case the work can be time-consuming, and time is also wasted because of the long period taken for the ladle to cool sufficiently for the relining or repair to be done.

It has now been found that these disadvantages may be overcome by the use of a lining material having particular properties.

According to a first feature of the invention there is provided in a teapot ladle having an outer metal shell and a spout extending from the floor of the ladle to a lip portion through which molten metal is poured when the ladle is tilted the improvement comprising the presence of an interior lining formed of low thermal capacity, low thermal conductivity refractory material which when in contact with molten metal poured into the ladle forms an erosion resistant surface, and means for retaining the lining in place when the ladle is tilted.

According to a further feature of the invention there is provided a method of casting molten metal comprising the steps of providing a teapot ladle having an outer metal shell, a spout extending from the floor of the ladle to a lip portion, an interior lining formed of low thermal capacity, low thermal conductivity refractory material, and means for retaining the lining in place, pouring molten metal into the ladle without preheating of the ladle, tilting the ladle and pouring the molten metal through the spout of the ladle into a mould or another vessel, removing the lining retaining means and removing the interior lining from the ladle.

The lining material comprises inorganic fibrous material, particulate refractory material and an organic binder. The inorganic fibrous material may be for example asbestos, calcium silicate fibre, aluminosilicate fibre or alumina fibre. The particulate refractory material may be for example silica, alumina, zircon, olivine, magnesia, an aluminosilicate, such as chamotte, mullite or grog (crushed firebrick) or a carbonaceous material such as coke. The organic binder may be a synthetic or a natural resin or a carbohydrate such as starch. Examples of suitable resin binders include phenol-formaldehyde resins and urea-formaldehyde resins.

The lining material may also contain an exothermic component, for example a readily oxidisable metal such as aluminium, if desired.

The ladle bottom is lined with a flat board of the lining material conforming to the shape of the ladle base, and the sides of the ladle are lined with a single tapered sleeve of the lining material or a series of whole or segmental boards made from the lining material.

The thickness of the lining is preferably from 1 to 5 cm.

The lining may be mounted directly in contact with the ladle casing or the ladle may first be lined with an intermediate lining of for example bricks, castable refractory material or silicate-bonded sand and the lining placed against that intermediate lining. In another modification a layer of particulate material such as silica sand, olivine sand or magnesite may be used between the intermediate layer and the lining or between the casing and the lining.

The retaining means for keeping the lining in place may be for example a refractory or metal ring which clips over the outer wall of the ladle and over the inner wall of the lining, or a series of clips which chip over the ladle and the lining. The retaining means may also be a shaped rod which fits over the top of the ladle and holds the lining in place at one point on its perimeter. Such means can be raised and rotated out of the vicinity of the lining so that the lining can be replaced. Any means which prevents the lining, and particulate material, if used, from falling out when metal is being poured from the ladle, but which can be readily removed to allow the lining to be removed after the ladle has been emptied, may be used. The retaining means may be expendable, i.e. used once only, or reusable.

When the retaining means has been removed the lining may be removed by inverting the ladle and allowing the lining to fall out. Alternatively metal straps may be pre-emplaced behind the lining and the lining may then be removed by lifting using the straps.

The spout for transporting molten metal from the ladle cavity to the lip may be provided by inserting a barrier of refractory material extending across the lip portion of the ladle and downwardly towards the floor of the ladle so as to produce an aperture between the bottom of the barrier and the floor.

The barrier may be constructed of the same material as the lining around the perimeter of the ladle and may conveniently be held in place by means of grooves in the lining into which the barrier fits. The barrier is preferably tapered so that on installation it wedges the lining tight against the intermediate lining or the casing.

Alternatively when the ladle is lined with an intermediate lining, the passageway or spout may be formed in that intermediate lining, extending from the ladle cavity at the bottom of the ladle to the lip. For example, a preformed refractory tube may be located so that its upper end is near to the lip of the ladle, and silicate-bonded sand may then be rammed around the tube to form the intermediate lining. When the spout is formed in an intermediate lining it will usually be necessary to heat the spout prior to use to prevent metal solidifying on the walls of the spout, or to line the spout with the same low thermal capacity, low thermal conductivity refractory material as is used on the sides and bottom of the ladle.

Figure 2:
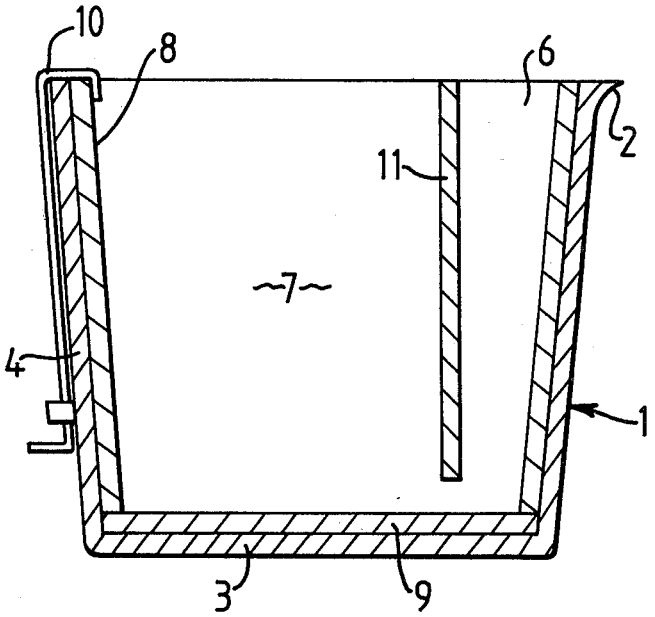
Figure 3:
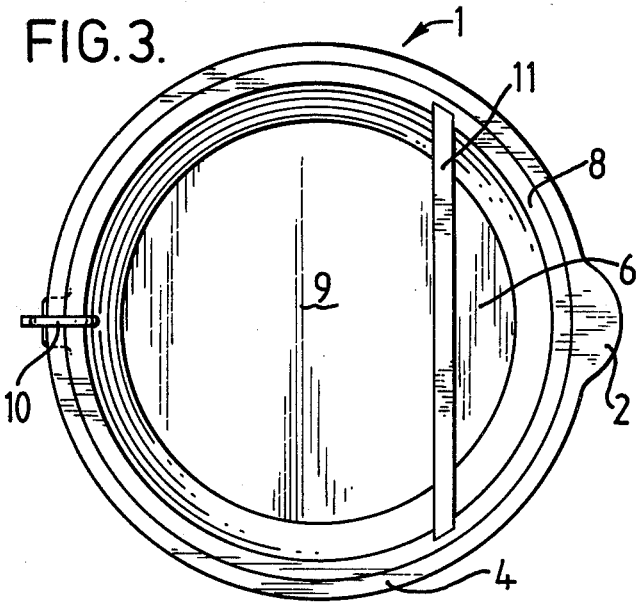

The invention is illustrated with reference to the accompanying drawings in which FIG. 1 is a sectional view of a teapot ladle according to the invention FIG. 2 is a sectional view of an alternative teapot ladle according to the invention and FIG. 3 is a plan view of the teapot ladle of FIG. 2 viewed from above.

Referring to FIG. 1, a teapot ladle consists of a metal container 1 of circular cross-section and tapering slightly outwardly from bottom to top, and having a lip 2 for pouring molten metal. The base 3 and wall 4 of the ladle are lined with an intermediate lining 5 of a cast refractory material. A spout 6 is formed in the intermediate lining 5 extending from the bottom of the ladle cavity 7 to near the lip 2.

A tapered sleeve 8 of low thermal capacity, low thermal conductivity refractory material is placed inside the cavity 7 in contact with the intermediate lining 5. The bottom of the sleeve 8 rests on a flat board 9 of the material from which the sleeve 8 is made placed on the floor of the ladle. The top end of a shaped metal rod 10 is fitted over the outer wall of the metal container 1 and over the inner wall of the sleeve 8 so as to hold the sleeve in place.

The sleeve 8 has an aperture near its lower end connecting the cavity 7 with the spout 6.

When the cavity 7 is filled with molten metal the ladle may be tilted to pour metal through the spout and out of the lip without dislodging the sleeve 8. After the ladle has been emptied the rod 10 is raised and rotated so that the upper end moves away from the interior of the ladle. The sleeve 8 and board 9 can then be readily removed and replaced.

Referring to FIGS. 2 and 3 a teapot ladle consists of a metal container 1 of circular cross-section and tapering slightly outwardly from bottom to top, and having a lip portion 2 for pouring molten metal.

A tapered sleeve 8 of low thermal capacity low thermal conductivity refractory material lines the cavity 7 and is in direct contact with the metal container. The sleeve 8 is placed on a disc 9 of low thermal capacity, low thermal conductivity refractory material on the floor of the ladle, and is held in place by means of metal rod 10, which functions as described with reference to FIG. 1.

A barrier 11 of the same material as that which is used to make the sleeve 8 is inserted in grooves cut in the wall of the sleeve 8. The barrier 11 extends across the ladle and downwardly towards the bottom of the ladle so as to produce an aperture between the bottom of the barrier and the ladle floor and to form the spout 6 to enable molten metal to flow from the cavity 7 to the lip portion 2.

A teapot ladle similar to that shown in FIG. 1 was lined with a castable aluminosilicate refractory material which was hand-poured and rammed round a steel mandrel. The lining had a thickness of 3–5 cm.

A 2.5 cm thick, preformed interior lining of a slightly exothermic heat-insulating material containing aluminosilicate fibre and aluminium was then inserted in the ladle. Any gaps between the interior and intermediate linings were filled with powdered grog. The interior lining was held in place by means of a metal rod as illustrated in the drawing.

The lined ladle was used to hold and cast molten steel poured into the ladle at 1650° C. and cast into two moulds over a period of 10 minutes. A layer of vermiculite approximately 2.5 cm thick was placed on the surface of the molten steel immediately after the ladle was filled. At the end of the 10 minutes the steel remaining in the ladle was still molten.

After the ladle was emptied there was virtually no skull remaining and there was little evidence of erosion of the lining. The ladle was allowed to cool and then inverted and the interior lining dropped out readily. The cast refractory intermediate lining was still in excellent condition and there was no evidence of steel penetration through the interior lining.

I claim:

1. In a teapot ladle having an outer metal shell and a spout extending from the floor of the ladle to a lip portion through which molten metal is poured when the ladle is tilted the improvement comprising: means for providing a discardable interior lining formed of low thermal capacity, low thermal conductivity refractory material which when in contact with molten metal poured into the ladle forms an erosion resistant surface, and which readily separates from the ladle after use; and means for retaining the lining in place when the ladle is tilted.

2. A teapot ladle according to claim 1 wherein the means for retaining the lining in place is a refractory or metal ring which clips over the outer wall of the ladle and over the inner wall of the lining.

3. A teapot ladle according to claim 1 wherein the means for retaining the lining in place is a series of clips which clip over the ladle and the lining.

4. A teapot ladle according to claim 1 wherein the means for retaining the lining in place is a rod shaped to fit over the top of the ladle and to hold the lining in place at one point on its perimeter.

5. A teapot ladle according to claim 1 wherein the material of which the lining is formed comprises inorganic fibrous material, particulate refractory material and an organic binder.

6. A teapot ladle according to claim 5 wherein the inorganic fibrous material is selected from the group consisting of asbestos, calcium silicate fibre, aluminosilicate fibre and alumina fibre.

7. A teapot ladle according to claim 5 wherein the particulate refractory material is selected from the group consisting of silica, alumina, zircon, olivine, magnesia, aluminosilicates and carbonaceous materials.

8. A teapot ladle according to claim 5 wherein the organic binder is selected from the group consisting of synthetic resins, natural resins and carbohydrates.

9. A teapot ladle according to claim 5 wherein the lining material also contains an exothermic component.

10. A teapot ladle according to claim 1 wherein the lining is in the form of a tapered sleeve.

11. A teapot ladle according to claim 1 wherein the lining is made up of a series of whole or segmental boards.

12. A teapot ladle according to claim 1 wherein the interior lining is from 1 cm to 5 cm thick.

13. A teapot ladle according to claim 1 wherein the spout is formed by means of a barrier of refractory material extending across the lip portion of the ladle and downwardly towards the floor of the ladle so as to produce an aperture between the bottom of the barrier and the floor.

14. A teapot ladle according to claim 1 wherein an intermediate lining is present between the metal shell and the interior lining.

15. In a teapot ladle having an outer metal shell and a spout extending from the floor of the ladle to a lip portion through which molten metal is poured when the ladle is tilted, and with an intermediate lining adjacent the metal shell, the improvement comprising: the presence of an interior lining formed of low thermal capacity, low thermal conductivity refractory material which when in contact with molten metal poured into the ladle forms an erosion resistant surface, and means for retaining the lining in place when the ladle is tilted; and wherein the spout is formed in the intermediate lining in the lip portion.

16. A teapot ladle according to claim 15 wherein the spout is lined with the material used to form the interior lining.

17. A teapot ladle comprising: an outer metal shell; a lip portion through which molten metal is poured when the ladle is tilted; an interior discardable lining adjacent the shell formed of low thermal capacity, low thermal conductivity refractory material which when in contact with molten metal poured into the ladle forms an erosion resistant surface; a retaining rod having a shaft portion extending vertically along the exterior of said outer metal shell and having a hook portion integral with the shaft and extending over the top of said shell, and the top the discardable lining and holding the lining in place at one point on its perimeter; and a spout, disposed opposite the rod hook portion, formed by means of a barrier of the refractory material used to form the interior lining extending across the lip portion of the ladle and downwardly towards the floor of the ladle so as to produce an aperture between the bottom of the barrier and the floor.

18. A teapot ladle comprising an outer metal shell, a lip portion through which molten metal is poured when the ladle is tilted, an intermediate lining adjacent the shell, an interior lining formed of low thermal capacity, low thermal conductivity refractory material which when in contact with molten metal poured into the ladle forms an erosion resistant surface, a retaining rod fitting over the top of the ladle and holding the lining in place at one point on its perimeter, and a spout formed in the intermediate lining and extending from the ladle cavity at the bottom of the ladle to the lip.

19. A foundry ladle comprising: an outer metal generally bucket-shaped casing having a base and arcuate side walls, a permanent refractory lining located on the inside of the casing, an inner protective discardable lining located in the ladle so as to shield the permanent lining, the inner lining being formed of one or more floorboards and one or more side boards, the one or more side boards being arranged essentially vertically and being wider at the top than at the base and being formed of a composition which is refractory, has relatively high heat insulation and relatively low heat conductivity.

20. A foundry ladle according to claim 19, in which the protective discardable lining has been preformed and then fitted within the ladle.

21. A foundry ladle according to claim 19 wherein the lining is in the form of a tapered sleeve.

22. A foundry ladle according to claim 21 further comprising a rod comprising means for retaining the tapered sleeve in place within the foundry ladle, and comprising a shaft vertically slidable over the exterior of the ladle, and having a hook portion extending over the top of the ladle and into engagement with said sleeve to hold said sleeve in place when in engagement therewith.

23. A method of utilizing a teapot ladle to cast molten metal, the ladle having an outer metal shell and a spout extending from the floor of the ladle to a lip portion, comprising the steps of sequentially: disposing a discardable interior lining, formed of low thermal capacity, low thermal conductivity refractory material, within the ladle, completely covering the ladle interior; retaining the discardable lining in place during tilting action of the ladle; pouring molten metal into the ladle, without preheating of the ladle; tilting the ladle and pouring the molten metal from the ladle through the spout of the ladle into a mould or another vessel; terminating retention of the discardable lining in place upon tilting of the ladle; and tilting the ladle so that the interior discardable lining falls out.

24. A method of supplying substantially inclusion-free molten metal from an unpreheated ladle with a relatively permanent lining, to a mould, comprising the steps of sequentially:

(a) locating in the ladle, so as to shield the molten metal from contact with the relatively permanent lining, an inner protective discardable lining formed of a composition which is refractory, has a relatively high heat insulation and a relatively low heat conductivity, and is readily separable from the ladle relatively permanent lining;

(b) pouring from a furnace molten metal into the ladle;

(c) pouring the molten metal from the ladle into a casting mould; and (d) readily separating the used discardable lining from the ladle, and discarding the used lining.

25. A method according to claim 24 wherein step (d) is practiced after one use.

26. A method according to claim 24, wherein step (d) is practiced only after multiple use.

27. A method according to claim 24, in which the metal is tapped from a furnace to the ladle at a temperature substantially the same as the casting temperature.

28. A method according to claim 24 wherein step (a) is practiced by providing a rod having a shaft vertically slidable over the ladle exterior, and having a hook portion extendable over the ladle and discardable lining, and moving the rod so that the hook portion moves into engagement with the ladle and the inner discardable lining to hold the lining in place even during tilting of the ladle; and wherein step (c) is practiced by tilting the ladle.

29. A method according to claim 28 wherein step (d) is practiced by moving the rod so that the hook portion no longer engages the ladle and interior lining, and inverting the ladle so that the inner discardable lining falls out.

30. In the foundry art of casting molten from a furnace to a preheated ladle with a relatively permanent lining, and from thence into a casting mould, the improvement which comprises the steps of sequentially:

(a) locating in the ladle before the metal is tapped therein and so as to shield the molten metal from contact with the relatively permanent lining, an inner protective discardable lining formed of a composition which is refractory, has a relatively high heat insulation and a relatively low heat conductivity;

(b) pouring from the furnace molten metal into the ladle in the absence of preheating thereof;

(c) pouring the molten metal from the ladle into a casting mould; and (d) readily separating the used discardable lining from the ladle and discarding it.

* * * * *